US005208861A

United States Patent [19]

Fujii

[11] Patent Number: 5,208,861

[45] Date of Patent: May 4, 1993

[54] PITCH EXTRACTION APPARATUS FOR AN ACOUSTIC SIGNAL WAVEFORM

[75] Inventor: Shigeki Fujii, Hamamatsu, Japan

[73] Assignee: Yamaha Corporation, Hamamatsu, Japan

[21] Appl. No.: 365,188

[22] Filed: Jun. 12, 1989

[30] Foreign Application Priority Data

Jun. 16, 1988 [JP] Japan ..... 63-146875
Jun. 16, 1988 [JP] Japan ..... 63-146876
Jun. 16, 1988 [JP] Japan ..... 63-146877

[51] Int. Cl.[5] ..... G10L 5/00

[52] U.S. Cl. ..... 381/31; 381/34

[58] Field of Search ..... 381/36–38, 381/41, 49, 31; 369/513.5; 395/2

[56] References Cited

U.S. PATENT DOCUMENTS 4,063,030 12/1977 Zurcher ..... 381/49
4,443,857 4/1984 Albarello ..... 381/49
4,589,131 5/1986 Horvath et al. ..... 381/38
4,633,748 1/1987 Takashima et al. ..... 84/1.01

FOREIGN PATENT DOCUMENTS 6323200 1/1983 Japan .

*Primary Examiner*—Emanuel S. Kemeny
*Attorney, Agent, or Firm*—Spensley Horn Jubas & Lubitz

[57] ABSTRACT

A pitch extraction apparatus for extracting (detecting)a pitch of an acoustic signal which includes circuitry for calculating the stability of the acoustic signal. The stability calculation exhibits a larger value as the amplitude of the acoustic signal is larger and when the frequency is low. Pitch extraction is performed using the calculated stability. In addition, a pitch extraction apparatus which includes a pitch extractor for extracting a pitch of an acoustic signal by discriminating whether or not an input is a voiced or voiceless sound. Based on the determination that the input is a voiceless sound, the input to or the output from the pitch extractor will be inhibited.

14 Claims, 4 Drawing Sheets $$ECj = Xi + X_{i+1} + \quad + X_{i+4}$$

PITCH EXTRACTION APPARATUS FOR AN ACOUSTIC SIGNAL WAVEFORM

BACKGROUND OF THE INVENTION

1. Field of the Invention

The present invention relates to a pitch extraction apparatus for extracting a pitch (i.e., a pitch period, pitch frequency, or pitch time) of an acoustic wave, e.g., an musical instrument sound or a voice.

2. Prior Art

Most acoustic waveforms of musical sounds or voices have a periodically repetitive waveform except for a noise-like acoustic wave such as a voiceless sound, and a change characteristic of its period, i.e., a pitch period serves as an important parameter in acoustic analysis, synthesis, or recognition. For example, in an acoustic analysis/synthesis system, a pitch extraction result extracted by an analysis unit largely influences quality of a sound synthesized by a synthesis unit.

As a method of extracting a pitch period of an acoustic signal waveform, various methods of pitch extraction (e.g., a method of calculating an autocorrelation function on each frame having a time duration almost equal to a pitch period and extracting a pitch period on the basis of the autocorrelation function) are known (e.g., Japanese Patent Laid-Open (Kokai) Sho. No. 23200; W. Hess, "Pitch Determination of Speech Signal", Springer-Verlag Corp., 1983; Fujisaki et al., "A Novel Method for Pitch Extraction of Speech based on Running Analysis of the Waveform", Reference of Society for the Study of Speech, SP86-95; and the like).

The pitch extraction method is performed by calculating the autocorrelation function, which is widely used since the autocorrelation function can be calculated by processing in a time region, and the influence of a phase relationship between a waveform to be analyzed and a frame which is relatively small.

The pitch extraction method is an important theme for musical recognition, and various apparatuses for pitch extraction are already commercially available (e.g., IVL Corp., Pitch Rider series; FairLight Corp., VoiceTracker; Roland Corp., Voice Processor and MIDI Guitar; Casio Corp., MIDI Guitar; and the like). In these pitch extraction apparatuses, pitch information and intensity information obtained by a pitch extraction unit are converted to Note ON/OFF information, pitch bend information, and the like for a MIDI (Musical Instrument Digital Interface), and a MIDI sound source is connected to the output of the apparatus.

In a conventional pitch extraction apparatus, an overtone component and a double-pitch component of a pitch, a harmonic component other than a pitch, and the like cause erroneous extraction, thus posing a problem. In order to prevent such erroneous extraction, a pitch search range is limited (making a great account of smoothness) or an unnecessary frequency component is removed prior to pitch extraction.

However, many conventional pitch extraction apparatuses operate within the pitch range (80 to 300 Hz) of speech (voice). In these apparatuses, a filtering operation is performed prior to pitch extraction to remove unnecessary harmonic components, and a smooth pitch track is then extracted. On the other hand, a musical instrument sound has a pitch range as wide as about 40 to 1200 Hz. If the abovementioned conventional extraction technique is employed, a high-pitch portion cannot be extracted. Therefore, extracting a pitch of the musical instrument sound, a pitch extraction apparatus needs countermeasures against a sound whose pitch abruptly changes and contains a high-pitch sound unlike normal voice.

In a small-amplitude duration included in a signal wave, pitch excitation tends to be unstable, and hence, pitch estimation becomes unstable.

Conventionally, in order to remove an irregular pitch variation and to obtain a smooth pitch track, estimated values for several frames are often buffered to correct the variation. However, since this technique prolongs a response time, it cannot be used in a real-time system. More specifically, when an apparatus is designed with an object that the previous lookup of a pitch (reference to pitch data extracted previously) is never performed, it is important to improve reliability of estimated values at respective timings.

In pitch extraction processing, since discrimination of durations where a pitch structure may or may not be present largely influences the final result, discrimination of a voiced/voiceless sound must be performed. The voiced/voiceless sound discrimination is performed using various feature parameters. For example, a typical technique using a parameter such as a zero-crossing count, a zero-crossing distance, an LPC primary coefficient, or the like is known. The conventional voiced/-voiceless sound discrimination is performed in parallel processing besides pitch extraction processing. Therefore, a processing volume is increased, and logic is complicated.

The present invention has been made in consideration of the conventional problems, and has as its first object to provide a pitch extraction apparatus which can more stably extract a pitch of an acoustic wave over a wide range.

It is a second object of the present invention to provide a pitch extraction apparatus which can extract a pitch of an acoustic wave over a wide range in real time.

It is a third object of the present invention to provide a pitch extraction apparatus which can perform voiced/voiceless sound discrimination with a small processing volume and simple logic, and can extract only a pitch of a voiced sound duration using said discrimination result in the case of extracting a pitch from an input acoustic signal in real time.

SUMMARY OF THE INVENTION

In order to achieve the first object, a pitch extraction apparatus according to a first aspect of the present invention comprises pitch extraction means for extracting a pitch of an acoustic signal waveform, means for calculating, on the basis of the acoustic signal waveform, stability which exhibits a larger value as an amplitude of the waveform which is larger and a frequency of the waveform which is lower, and multiplying means for calculating a product of the stability and the acoustic signal. The pitch extraction means performs pitch extraction on the basis of a product signal output from the multiplying means.

In order to achieve the second object, a pitch extraction apparatus according to a second aspect of the present invention comprises pitch extraction means for extracting a pitch of an acoustic signal waveform, means for calculating, on the basis of the acoustic signal waveform, stability which exhibits a larger value as an amplitude of the waveform is larger and a frequency of the waveform is lower, and control means for, when the pitch extracted by the pitch extraction means abruptly changes and the stability is low, controlling to stop pitch output.

In order to achieve the third object, a pitch extraction apparatus according to a third aspect of the present invention comprises pitch extraction means for extracting a pitch of an acoustic signal waveform, noise level discrimination means for comparing the input acoustic signal waveform with a predetermined noise level to discriminate whether or not the input waveform is a voiceless sound, and gate means, arranged at an input or output side of the pitch extraction means, for, when the noise level discrimination means determines that a input waveform is the voiceless sound, inhibiting an input to or an output from the pitch extraction means.

DETAILED DESCRIPTION OF THE PREFERRED EMBODIMENT

The present invention will now be described below with reference to the accompanying drawings.

Figure 1:
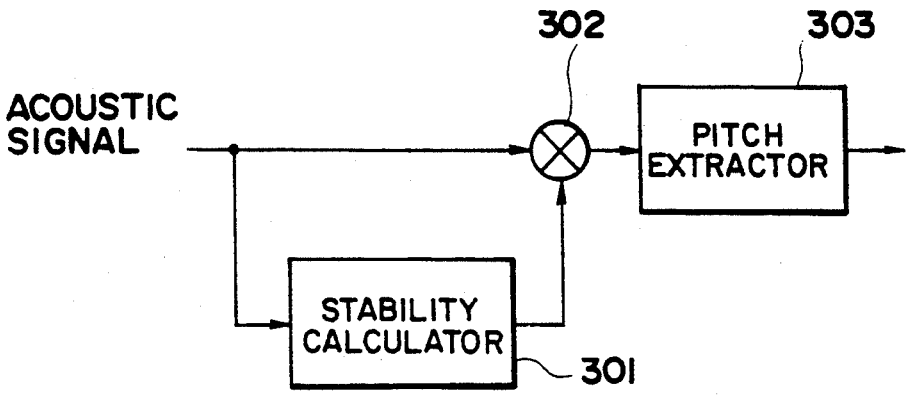
FIG. 1 is a schematic block diagram of a pitch extraction apparatus according to the first aspect of the present invention.

Referring to FIG. 1, in the first aspect of the present invention, stability exhibiting a larger value as an amplitude of an input acoustic signal which is larger and a frequency of the signal which is lower is calculated by a stability calculator 301. A multiplier 302 calculates a product of the stability and an input acoustic signal, and supplies the product signal to a known pitch extractor 303 to perform pitch extraction.

With the above arrangement, an input acoustic signal is multiplied by the stability by the multiplier 302. For this reason, the product signal output from the multiplier 302 has a larger amplitude as the stability is higher, and vise versa. The pitch extractor 303 performs pitch extraction on the basis of this product signal.

The "stability" implies stability of an extraction state of the pitch extraction apparatus, and is a function as a measure of reliability of the extracted result. The stability exhibits a larger value as an input acoustic signal has a larger amplitude and a lower frequency. Therefore, a high-frequency, small-amplitude portion of the input acoustic signal is suppressed by the multiplier 302, and a signal whose large-amplitude, low-frequency characteristics are emphasized is input to the pitch extractor 303. The pitch extraction means 303 performs pitch extraction on the basis of this signal.

Figure 2:
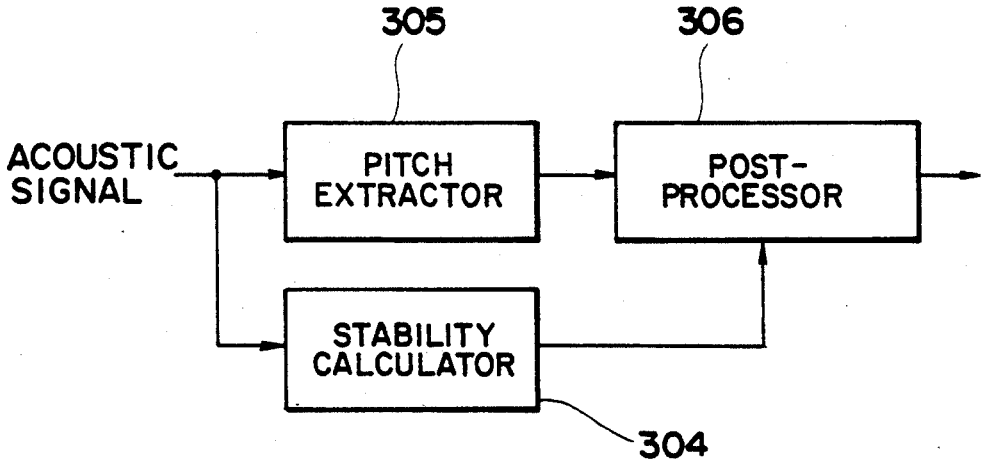
FIG. 2 is a schematic block diagram of a pitch extraction apparatus according to the second aspect of the present invention.

Referring to FIG. 2, in the second aspect of the present invention, stability exhibiting a larger value as an amplitude is larger and a frequency is lower is calculated by a stability calculator 304. Meanwhile, a pitch is extracted by a known pitch extractor 305. When a post-processor 306 detects an abrupt change in extracted pitch, the stability is referred to. When the stability is low, a pitch output is stopped.

With the above arrangement, stability of an input acoustic signal is calculated by the stability calculator 304. The pitch extractor 305 extracts a pitch on the basis of the input acoustic signal. When the extracted pitch as an output from the pitch extractor 305 exhibits an abrupt change, the post-processor 306 refers to the stability. When the stability is high, the post-processor 306 outputs the pitch. When the stability is low, the post-processor 306 ignores the pitch and does not output it.

Figure 3:
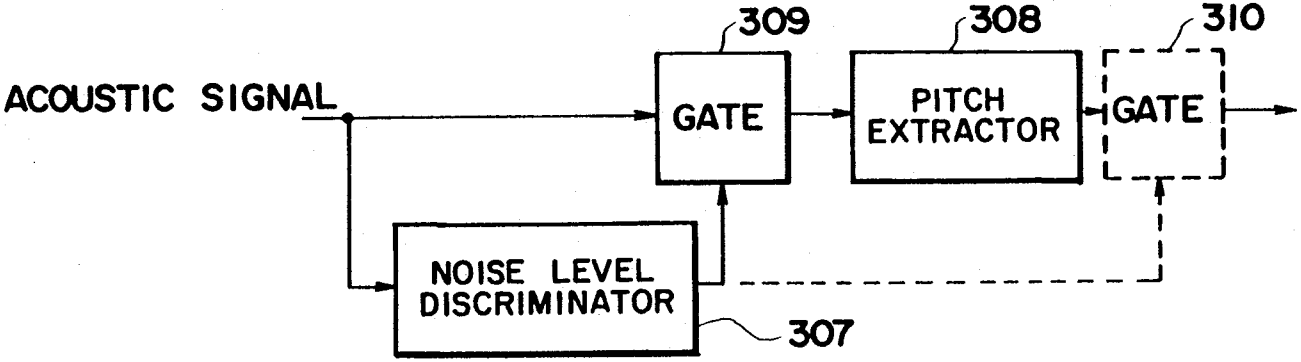
FIG. 3 is a schematic block diagram of a pitch extraction apparatus according to the third aspect of the present invention.

Referring to FIG. 3, in the third aspect of the present invention, a noise level discriminator 307 compares an average amplitude value of an input acoustic signal with a background noise level, and outputs a signal indicating a voiced/voiceless sound to a gate 309 (or 310). The gate 309 (or 310) turns on/off an input (or output) of a pitch extractor 308 on the basis of the input signal from noise level discrimination discriminator 307.

With the above arrangement, an input acoustic signal is input to the noise level discriminator 307, and is compared with a prestored background noise level. As the background noise level, an acoustic signal immediately after power-on is held and used. Upon comparison in the noise level discriminator 307, when the input acoustic signal is larger than a predetermined multiple of the background noise level, a voiced sound is determined; otherwise, a voiceless sound is determined. The signal indicating a voiced/voiceless sound is sent from the noise level discriminator 307 to the gate 309. As a result, only when the signal indicates the voiced sound, the gate 309 sends the input acoustic signal to a pitch extractor 308; otherwise, does not send the input acoustic signal. Thus, stable pitch extraction can be performed in a voiced sound duration other than a non-pitch duration.

The gate can be arranged at either the input or output side of the pitch extraction means. Reference numeral 310 denotes a gate arranged at the output side.

Figure 4:
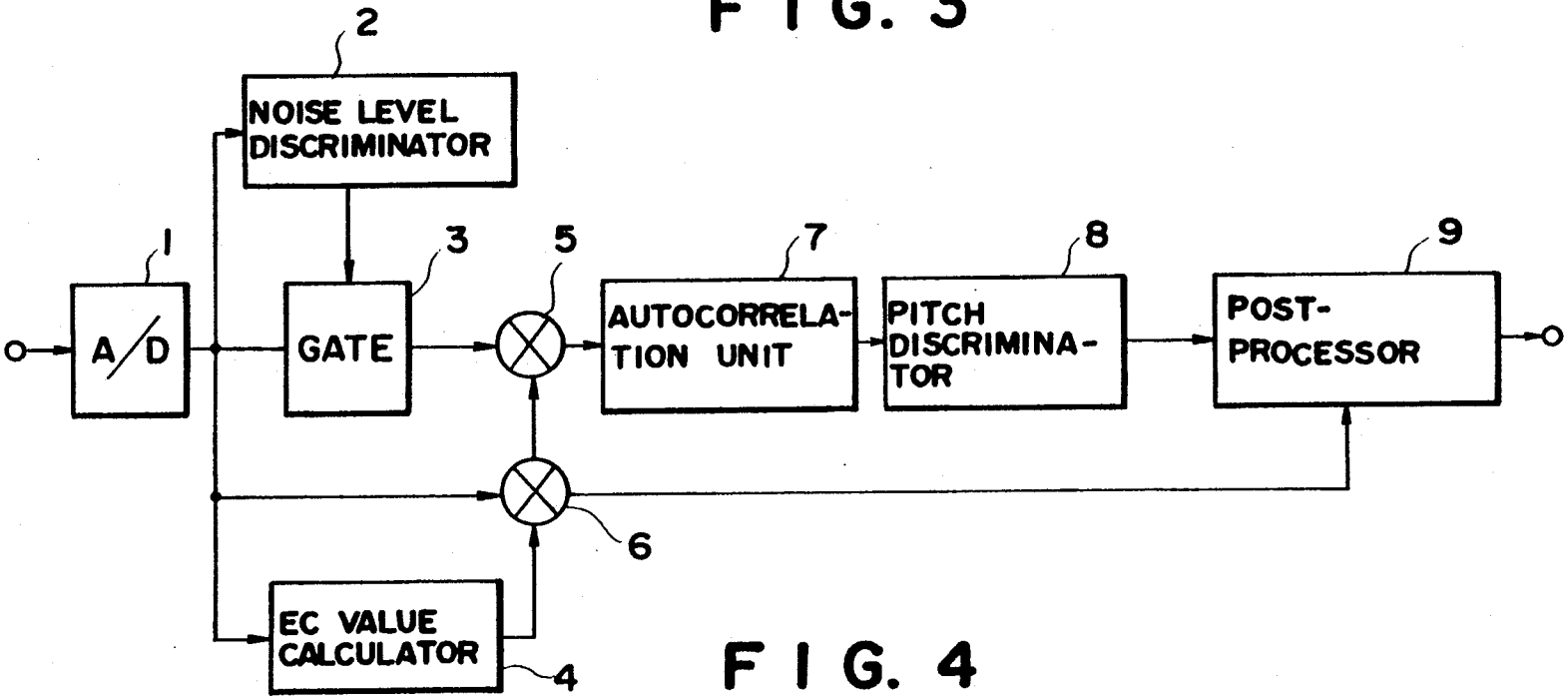
FIG. 4 is a block diagram showing an arrangement of a pitch extraction apparatus according to an embodiment of the present invention.
Figure 5:
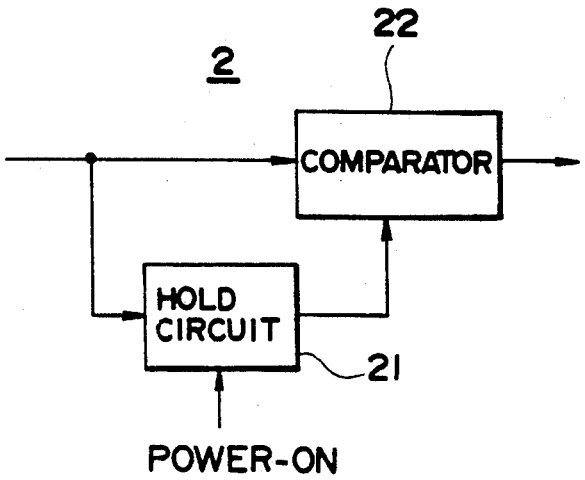
FIG. 5 is a block diagram showing a circuit of a noise level discriminator of the pitch extraction apparatus shown in FIG. 4.
Figure 6:
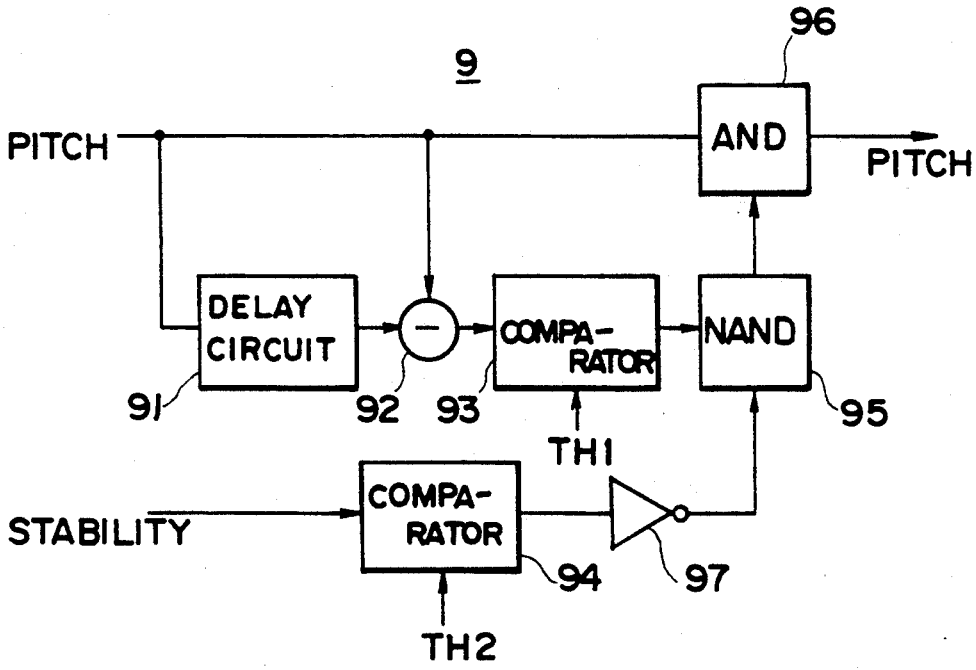
FIG. 6 is a block diagram showing a circuit of a post-processor of the pitch extraction apparatus shown in FIG. 4.

FIG. 4 is a block diagram showing an arrangement of the pitch extraction apparatus according to an embodiment of the present invention. FIG. 5 is a block diagram showing a circuit of a noise level discriminator 2 shown in FIG. 4, and FIG. 6 is a block diagram showing a circuit of a post-processor 9.

The operation of the apparatus of this embodiment will be described below with reference to FIGS. 4 to 6.

When an acoustic signal (analog signal) such as a voice or music is input, they are converted to digital signals by an A/D converter 1. The digital acoustic signal is output to a noise level discriminator 2, a multiplier 6, a gate 3, and an EC value calculator 4.

The noise level discriminator 2 receives the digital acoustic signal, and compares it with a background noise level, and outputs a signal indicating whether or not the input signal is a voiceless sound to the gate 3. The noise level discriminator 2 in FIG. 4 corresponds to the noise level discriminator 307 in FIG. 3.

The operation of the noise level discriminator 2 will be described below with reference to FIG. 5. The noise level discriminator 2 receives a power-on signal, and holds an output level of the A/D converter 1 (FIG. 4) at that time in a hold circuit 21. The held signal level is used as the background noise level. Note that the background noise level may be measured for several seconds upon power-on. The initial measurement result is used as an initial value of the background noise level. Thereafter, this value may be adaptively changed in accordance with an input signal.

A comparator 22 compares an input acoustic signal (digital signal) with the background noise level from the hold circuit 21. When the input acoustic signal is smaller than 1.4 times (this value can be adjusted by a user) the background noise level, the comparator 22 determines a voiceless sound, and outputs a signal indicating the voiceless sound in a voiceless sound duration. In this case, a new background noise level may be determined on the basis of an acoustic signal level value when a voiceless sound is determined and a previous background noise level value.

Referring to FIG. 4, the signal indicating whether or not the input signal is a voiceless sound from the noise level discriminator 2 is input to the gate 3. Thus, when the signal indicates the voiceless sound, the gate 3 is disabled, and the digital acoustic signal output from the A/D converter 1 is not input to a multiplier 5.

The operation of the EC value calculator 4 will be described below. The EC value calculator 4 receives the digital acoustic signal output from the A/D converter 1, and calculates an EC value. The "EC value" is an abbreviation of an Execution Cycle value, and is a total sum of sample values at all the sampling points present between two successive zero-crossing points in a signal.

Figure 7A:
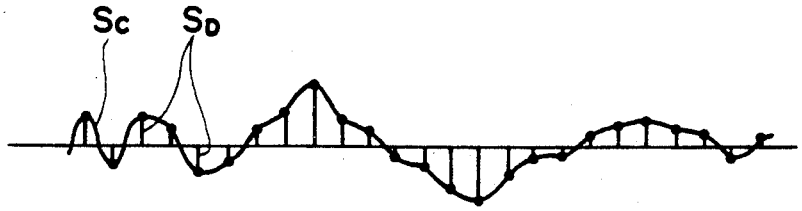
FIGS. 7A and 7B are graphs of an acoustic signal, and the like for explaining an EC value.
Figure 7B:
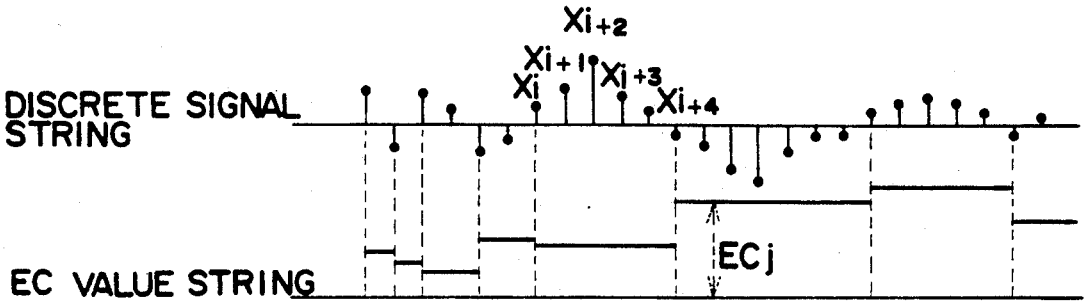

FIG. 7A is a graph showing a state wherein a continuous acoustic signal $S_C$ is sampled at predetermined sampling intervals by the A/D converter 1 to obtain sample values $S_D$ as the digital acoustic signals. Of the sample values obtained described above, a total sum of the sample values present between two zero-crossing points, e.g., $X_i$ to $X_{i+4}$ in FIG. 7B is calculated to obtain an EC value:

$$EC_j = X_i + X_{i+1} + \ldots + X_{i+4}$$

The EC value is inversely proportional to a frequency, and is proportional to an amplitude. In the apparatus of this embodiment, reliability of pitch extraction is improved by utilizing such characteristics.

Referring again to FIG. 4, the EC value calculated by the EC value calculator 4 is multiplied by an original digital acoustic signal by the multiplier 6. Thus, stability is calculated. The "stability" implies stability of an extraction state of the pitch extraction apparatus, and is a function as a measure of reliability of the extracted result.

The EC value is inversely proportional to a frequency. Therefore, for signals having the same amplitude and different frequencies, the EC value takes a larger value as a lower frequency signal is input. If high frequency components of a signal wave are increased, erroneous pitch extraction may frequently occur. Therefore, the EC value can be used as a factor of a stability function.

The EC value is proportional to an input amplitude. Therefore, for signals having the same frequency and different amplitudes, the EC values takes a larger value as the amplitude is larger. With this nature, the EC value can well reflect a situation that a small-amplitude signal often accompanies an unstable pitch variation. In some cases, the EC value is locally decreased under the influence of an overtone component of a pitch. In this case, the stability value must be corrected by any means. In this embodiment, the EC value is multiplied by the original digital acoustic signal by the multiplier 6 to relax a local variation. A value to be multiplied by the EC value can adopt an average amplitude value within a predetermined period of time of a digital acoustic signal.

The stability is calculated on the basis of the EC value having the above-mentioned characteristics. When a large-amplitude, low-frequency acoustic signal is input, the stability inevitably exhibits a large value. Contrary to this, when a small-amplitude, high-frequency acoustic signal is input, the stability exhibits a small value. The EC value calculator 4 and multiplier 6 in FIG. 4 correspond to the stability calculator 301 and 304 in FIGS. 1 and 2.

The stability is output to the post-processor 9, and the multiplier 5. The multiplier 5 multiplies the digital data string of the acoustic signals as an output from the gate 3 with the stability calculated as described above. When the voiceless sound is detected, the output from the multiplier 5 is zero. When a voiced sound is detected, an output whose large-amplitude, low-frequency characteristics are emphasized is output from the multiplier 5. The multiplier 5 in FIG. 4 corresponds to the multiplier 302 in FIG. 1.

Figure 8:
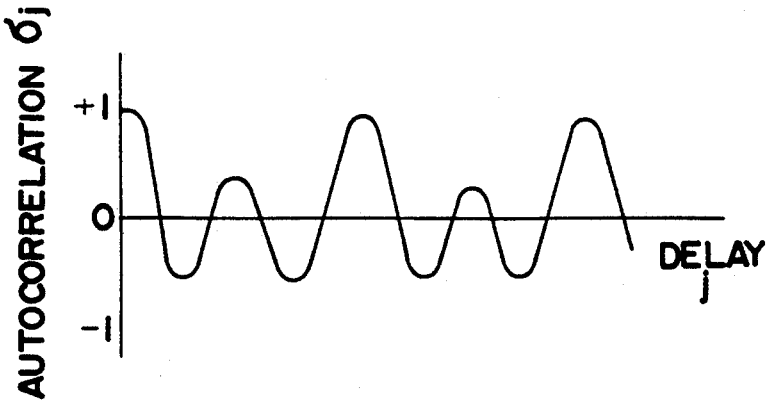
FIG. 8 is a graph showing a calculation result of an autocorrelation function.

An autocorrelation unit 7 calculates and adds autocorrelation functions of input signal series on each sample, and outputs to a pitch discriminator 8 on each frame period. FIG. 8 is a graph showing a calculation result of an autocorrelation function. In this embodiment, the autocorrelation function is calculated by an autocorrelation function calculation method using the following equation:

$$\sigma_j = \frac{\sum_{i=0}^{N} X_i \cdot X_{i+j}}{\sum_{i=0}^{N} X_i^2}$$

Note that a method of using a semi-infinite region of an attenuating exponential function may be employed. When a frame period is long, the autocorrelation calculation method is advantageous in calculation cost.

The pitch discriminator 8 estimates a pitch period from the output of the autocorrelation unit 7. Basically, the processing content of the discriminator 8 is a secondary interpolation for detecting a maximum peak position and increasing pitch precision. In this embodiment, the following restriction condition (discrimination condition) is given.

Assume that a pitch search range ranges from +400 cents of an immediately preceding frame pitch to −400 cents.

More specifically, the pitch discriminator 8 calculates a delay time j (pitch) yielding a maximum autocorrelation $\sigma_j$ of the delay time j of the waveform shown in FIG. 8. The autocorrelation unit 7 and the pitch discriminator 8 in FIG. 4 correspond to the pitch extractor 303, 305 and 308 in FIGS. 1, 2 and 3.

The post-processor 9 receives the pitch output from the pitch discriminator 8 and the stability output from the multiplier 6, and outputs a final pitch. The post-processor 9 in FIG. 4 corresponds to the post-processor 306 in FIG. 2. The operation of the post-processor 9 will be described in detail below with reference to FIG. 6.

A pitch input is delayed by a delay circuit 91 by a predetermined period of time, and then undergoes subtraction with an original signal by a subtractor 92. The difference is compared with a predetermined value TH1 by a comparator 93. When the output from the subtractor 92 (i.e., a difference between the delay signal and the present signal) is larger than the predetermined value TH1, a signal H(High) is output to a NAND gate 95; otherwise, a signal L(Low) is output thereto. The above arrangement is to detect an abrupt change in pitch. When a pitch makes a change larger than a given level (defined by the predetermined value TH1), the signal H is output.

The stability is compared with a predetermined value TH2 by a comparator 94. When a value represented by the stability is larger than the predetermined value TH2, a signal H(High) is output to an inverter 97; otherwise, a signal L(Low) is output thereto. Therefore, when the stability is larger than the predetermined value TH2, a signal L(Low) is output to the NAND gate 95; otherwise, a signal H(High) is output thereto.

The NAND gate 95 takes a NAND product of the outputs from the comparators 93 and the inverter 97. More specifically, when the pitch abruptly changes, the stability is referred to. If the stability is high, the pitch is output to an external device through an AND gate 96. If the stability is low when the pitch abruptly changes, the abrupt change is ignored.

As described above, a finally extracted pitch is output.

As described above, according to the present invention, there is provided a pitch extraction apparatus which can suppress a high-frequency, small amplitude portion and can emphasize a large-amplitude, low-frequency signal when pitch extraction is performed in real time from an input acoustic signal. Therefore when this apparatus is applied to a music sound, stable and smooth pitch extraction can be performed over a wide pitch range.

Even when a pitch abruptly changes, stable and smooth pitch extraction can be performed in real time.

Further, according to the present invention, there is provided a pitch extraction apparatus which can perform voiced/voiceless sound discrimination with a small processing volume and simple logic and can perform pitch extraction of only a voiced sound duration using the discrimination result when pitch extraction is performed in real time from an input acoustic signal. If a background noise level is appropriately changed in accordance with a condition of a signal, a background noise duration can be reliably determined.

What is claimed is:

1. A pitch extraction apparatus comprising:

stability calculating means for calculating, on the basis of an acoustic signal, stability which exhibits a larger value when the amplitude of the acoustic signal is relatively larger and the frequency of the acoustic signal is relatively lower;

multiplying means for calculating a product of said stability and said acoustic signal to provide a product signal; and pitch extraction means for extracting a pitch on the basis of the product signal output from said multiplying means.

2. An apparatus according to claim 1, wherein said stability calculating means calculates said stability on the basis of a total sum of sample values of said acoustic signal, said sample values being obtained by sampling the acoustic signal between two successive zero-crossing points in said acoustic signal.

3. An apparatus according to claim 2, wherein said stability calculating means calculates said stability by multiplying said acoustic signal by said total sum.

4. An apparatus according to claim 2, wherein said stability calculating means includes means for determining an average amplitude value of said acoustic signal within a predetermined period and calculates said stability by multiplying the average amplitude value by said total sum.

5. A pitch extraction apparatus according to claim 1, further comprising:

control means for inhibiting the pitch output when the pitch extracted by said pitch extraction means abruptly changes and the calculated stability is low.

6. An apparatus according to claim 5, wherein the stability calculating means calculates said stability on the basis of a total sum of samples values of said acoustic signal, said samples values being obtained by sampling the acoustic signal between two successive zero-crossing points in said acoustic signal.

7. An apparatus according to claim 6, wherein said stability calculating means calculates said stability by multiplying said acoustic signal by said total sum.

8. An apparatus according to claim 6, wherein said stability calculating means includes means for determining an average amplitude value of said acoustic signal within a predetermined period and calculates said stability by multiplying the average amplitude value by said total sum.

9. A pitch extraction apparatus according to claim 1, further comprising:

noise level discrimination means for comparing the input acoustic signal with a predetermined noise level to discriminate whether or not the input acoustic signal is a voiceless sound; and gate means, arranged at an input or output side of said pitch extraction means, for, when said noise level discrimination means determines that the input acoustic signal is the voiceless sound, inhibiting an input to or an output from said pitch extraction means.

10. An apparatus according to claim 9 wherein the apparatus includes noise level measurement means for measuring a noise level of the input acoustic signal and wherein a value of the noise level measured upon initial application of power to the apparatus is used as said predetermined noise level.

11. An apparatus according to claim 9 including means for determining an average amplitude value of said input acoustic signal and wherein said noise level discrimination means compares the average amplitude value with the predetermined noise level to discriminate whether or not said input acoustic signal is a voiceless sound.

12. An apparatus according to claim 10 including means for determining an average amplitude value of said input acoustic signal and wherein said noise level discrimination means compares the average amplitude value with the predetermined noise level to discriminate whether or not said input acoustic signal is a voiceless sound.

13. An apparatus according to claim 1, wherein said acoustic signal is a digital signal and further including an analog-to-digital converter for receiving an analog acoustic signal and digitizing it to provide the digital signal.

14. An apparatus according to claim 9, wherein said acoustic signal is a digital signal and further including an analog-to-digital converter for receiving an analog acoustic signal and digitizing it to provide the digital signal.

* * * * *